US007621972B2

(12) United States Patent
Mehlhose et al.

(10) Patent No.: US 7,621,972 B2
(45) Date of Patent: Nov. 24, 2009

(54) METHOD AND APPARATUS FOR DISCHARGING SLAG FROM GASIFICATION REACTORS

(75) Inventors: Friedemann Mehlhose, Freiberg (DE); Manfred Schingnitz, Freiberg (DE)

(73) Assignee: Siemens Aktiengesellschaft, München (DE)

( * ) Notice: Subject to any disclaimer, the term of this patent is extended or adjusted under 35 U.S.C. 154(b) by 237 days.

(21) Appl. No.: 11/638,119

(22) Filed: Dec. 13, 2006

(65) Prior Publication Data

US 2008/0047198 A1 Feb. 28, 2008

(30) Foreign Application Priority Data

Aug. 28, 2006 (DE) ..... 10 2006 040 077

(51) Int. Cl.
*C10J 3/52* (2006.01)
*C10J 3/46* (2006.01)

(52) U.S. Cl. ..... 48/210; 422/232; 48/62 R; 48/77

(58) Field of Classification Search ..... 48/62 R–87
See application file for complete search history.

(56) References Cited

U.S. PATENT DOCUMENTS 4,465,496 A * 8/1984 Suggitt ..... 48/197 R

FOREIGN PATENT DOCUMENTS

| | | |
|---|---|---|
| DE | 4 109 231 | 9/1992 |
| DE | 41 09 231 A1 | 9/1992 |
| DE | 196 08 093 C2 | 9/1997 |
| EP | 0 545 241 | 6/1993 |
| EP | 0 545 241 B1 | 6/1993 |

* cited by examiner

*Primary Examiner*—Jennifer K Michener
*Assistant Examiner*—Imran Akram
(74) *Attorney, Agent, or Firm*—Collard & Roe, P.C.

(57) ABSTRACT

A method and device for evacuating ash and slag from reactors for pressure gasification of fuels, said fuels including coals of various ranks, cokes or ash-containing liquids or liquid-solid suspensions, at pressures between ambient pressure and 80 bar at gasification temperatures ranging between 800 and 1,800° C. There is a water circuit for loosening the deposited slag between a gasification chamber downstream of which there is mounted a quench chamber to which there is connected a slag lock hopper. Circuit water is supplied to the upper and lower part of the quench chamber.

6 Claims, 2 Drawing Sheets

METHOD AND APPARATUS FOR DISCHARGING SLAG FROM GASIFICATION REACTORS

BACKGROUND OF THE INVENTION

1. Field of the Invention

The invention relates to a method and apparatus for discharging slag from gasification reactors. The invention is suited for discharging slag from reactors during gasification of ash-containing fuels. The invention can be used with any type of gasifier in which ash or slag is discharged from a pressure system.

2. The Prior Art

During pressure gasification of ash-containing fuels in dust form, in lumps or in liquid form, solid residues are formed from the fuel ash as a function of the gasification temperature, said residues being formed either in the form of slightly molten granulated ash or in the form of fully molten slag and being evacuated from the pressure systems after cooling. Fuel in dust form, in lumps or in liquid form is understood to refer to conventional fuels such as coals of various ranks, cokes of various origin, but also to solids-containing oils and tars as well as slurries that may be utilized as coal-water or coal-oil slurries or slurries obtained in the form of suspensions of pyrolysis coke and pyrolysis liquids from thermal pre-treatment using different pyrolysis methods of biomass.

Generally, the granulated ash or fully molten slag is cooled by injecting water and is collected in bulk form in a water bath, discharged from the pressure system through pressure lock hoppers and disposed of, or processed, into building materials.

Such type methods and apparatus are described in European Patent No. EP 0 545 241 B1 and German Patent No. DE 4 109 231. EP 0 545 241 B1 describes a method for thermal utilization of waste materials, combining actually known process steps such as pyrolysis, comminution, classification, gasification and gas purification in which CO— and $H_2$-containing gas and a slag are formed in a gasification reactor, the slag granulating upon contact with water and being discharged from the gasification reactor.

DE 4 109 231 C2 describes a method of recycling halogen-loaded, carbon-containing waste materials by which waste materials are converted in the entrained flow, according to the principle of partial oxidation, to a carbon monoxide- and hydrogen-containing crude gas. There is a water bath, in which the solidifying slag particles are received and discharged from the pressure reactor through a lock hopper, being disposed in the lower part of the reactor.

This technology has major disadvantages leading to operation failures and limiting the availability of the technology as a whole. Such failures are e.g., due to the solidification of the ashes/slags in the water bath, which is promoted by the solid substances forming in a wide range of grain sizes. The solidification leads to the formation of bridges and blocks the evacuation process.

The ashes/slags are cooled at gasification pressures of up to 80 bar at temperatures of up to between 150 and 250° C., water vapor forming during evacuation as a result of the expansion. Gases such as $CO_2$ and $H_2S$ simultaneously escaping from the pressure system during the expansion of the ash/slag/water mixture result in a toxic contamination of this water vapor therewith and secure cooling is complicated.

SUMMARY OF THE INVENTION

It is therefore an object of the invention to develop a method and an apparatus for cooling and evacuating granulated ashes and slags generated during gasification of ash-containing fuels that do not lead to failure in the evacuation process nor to the formation of contaminated water vapor that may be contaminated with toxic gases.

This object is solved by a method and device for evacuating ash and slag from reactors for pressure gasification of fuels, said fuels including coals of various ranks, cokes or ash-containing liquids or liquid-solid suspensions, at pressures between ambient pressure and 80 bar at gasification temperatures ranging between 800 and 1,800° C. There is a water circuit for loosening the deposited slag between a gasification chamber downstream of which there is mounted a quench chamber to which there is connected a slag lock hopper. Circuit water is supplied to the upper and lower part of the quench chamber.

Preferably, water at a temperature of between 20 and 90° C. is supplied to the slag lock hopper in order to cool the water bath and the layer of slag and to avoid or reduce the formation of vapor during expansion of the slag lock hopper.

Further, it may be advantageous to have the water circuit between the slag lock hopper and the quench chamber and the supply of water at temperatures of between 20 and 90° C. supplied simultaneously into the lower part of the slag lock hopper.

Likewise, it may be advantageous to have the water circuit between the slag lock hopper and the quench chamber and the supply of water at temperatures of between 20 and 90° C. supplied alternately into the lower part of the slag lock hopper.

The water circuit between the slag lock hopper and the quench chamber and the supply of water at temperatures of between 20 and 90° C. may be supplied continuously or discontinuously into the lower part of the slag lock hopper.

A comminution device for shredding coarse grained slag may be disposed in the lower part of the quench chamber.

The apparatus for carrying out the method consists of the gasification chamber and of a quench chamber mounted downstream thereof as well as of the slag lock hopper, water circuit lines connecting a water bath, the quench chamber and the slag lock hopper, and a feed pump for the water circuit being disposed within said lines.

It is advantageous to mount a water supply in the lower part of the slag lock hopper.

It is further advantageous to dispose a slag crusher in the lower part of the quench chamber.

The function of the invention will be described as follows:

The ash-containing fuel is supplied through lines to the gasification chamber and is converted to crude synthesis gas together with the gasification means supplied through lines. The gasification means consists of free oxygen or of mixtures of free oxygen with nitrogen, water vapor or $CO_2$. The gasification temperatures are adjusted in such a manner that they lie above the melting temperatures of the combustible ash. Hot crude gas and liquid slag then flow into the quench chamber in which both synthesis crude gas and slag are cooled by injecting quench water. The temperature thereby depends on the gasification pressure, which may be chosen in a range between 5 and 80 bar. The crude gas is saturated with water vapor. At a gasification pressure of 30 bar for example, the saturation temperature is about 200° C. The water vapor saturated crude gas leaves the quench chamber through the line and reaches gas purification stages mounted downstream thereof. In the lower part of the quench chamber, there is a water bath into which the slag, which has also been cooled to the quench temperature of 200° C., falls and reaches the slag lock hopper through the opened fitting and collects in bulk form in the lower part. Once a certain amount of slag has accumulated, the valve beneath the slag lock hopper, which was open until then, closes, the slag lock hopper expands and the valve opens so that the slag is discharged from the gasification and quench system through the outlet. Next, the valve beneath the slag lock hopper closes again, the valve between the quench chamber and the slag lock hopper opens for the slag lock hopper to again receive slag. If the slag is in the form of very big lumps, a slag crusher is mounted in the lower part of the quench chamber. While promoting the evacuation process, this also favors the risk of deposits and solidification as a result of the cross section becoming narrower, the fine grain formed having a particular impact.

The problems related to the solidification of the slag in the water bath of the quench chamber are solved by the pump feeding water continuously or intermittently from the slag lock hopper into the upper or lower part of the quench chamber so that a certain flow is maintained. In order to achieve the same effect in the slag lock hopper, additional water is introduced through the line into the lower part of the slag lock hopper. This additional water, which is fed through the line, has temperatures <50° C. in order to achieve an additional effect of cooling to temperatures <100° C. in the slag lock hopper. This allows avoiding or strongly minimizing the vapors occurring during the expansion of the slag lock hopper.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
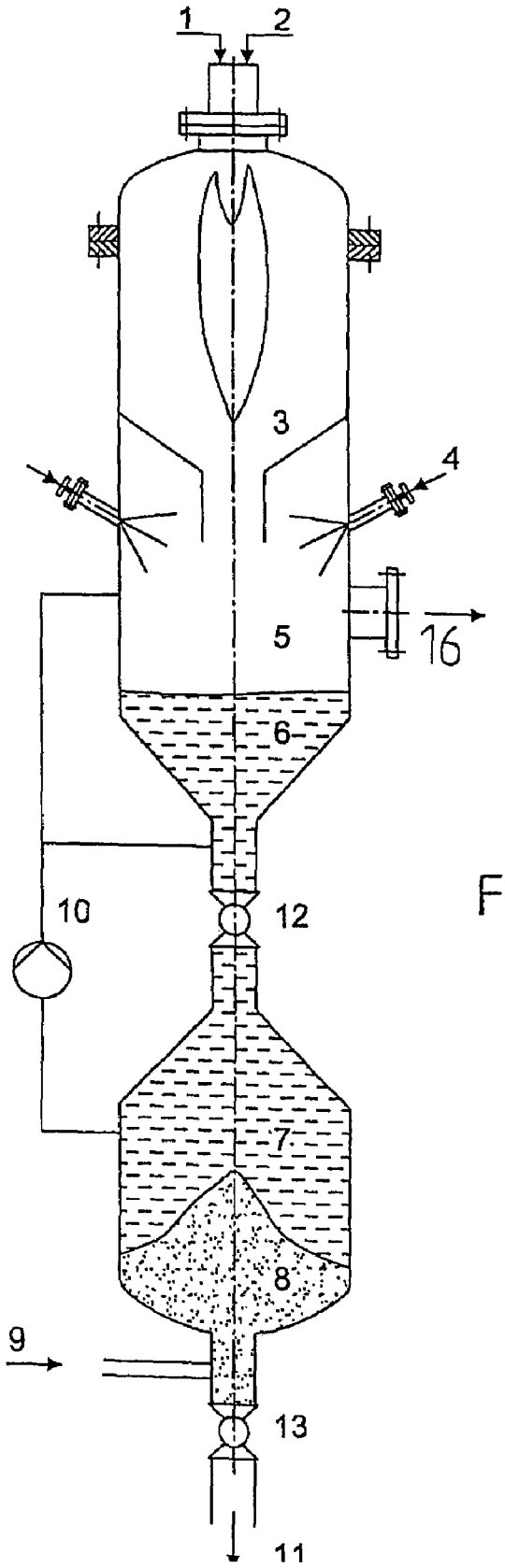
FIG. 1 shows a solution of the invention with gasification chamber, quench chamber and slag bath.

Referring now in detail to the drawings, FIG. 1 shows a gasification chamber 3 with fuel and gasification means supply 1, 2, nozzle equipment 4 and quench chamber 5 from which crude gas 16 is evacuated and in the lower part of which there is disposed a water bath 6. A valve 12 separates quench chamber 5 and slag lock hopper 7; in the lower part of slag lock hopper 7 there is bulk slag 8 that may be evacuated through an additional valve 13 and slag evacuation tube 11. A water supply 9 is disposed in the lower part of slag lock hopper 7. The pump with circuit lines 10 is disposed in such a manner that the water can be pumped back and forth in the lines between quench chamber 5, water bath 6 and slag lock hopper 7.

In a reactor for entrained flow gasification, 30 mg/h hard coal dust are supplied through line 1 and converted at 40 bar together with a gasification means oxygen/water vapor inflowing from line 2. The hard coal has an ash content of 10 Ma %, which corresponds to 3 Mg/h. Gasification is conducted so that the crude gasification gas leaves gasification reactor 3 together with the molten ash in the form of slag at a temperature of 1,400° C. and is cooled down to 220° C. in quench chamber 5 with quench water supplied through nozzle system 4. Crude gas 16 flowing out has the same temperature.

To lower the temperature in water bath 6 and in bulk slag 8 and to break up and cool said slag, water is supplied at a temperature of 30° C. through line 9 into the lower part of slag lock hopper 7 and circulated to quench chamber 5 through pump 10. This causes the temperature in water bath 6 and in bulk slag 8 to lower before evacuation is initiated by closing valve 12 and opening valve 13.

Figure 2:
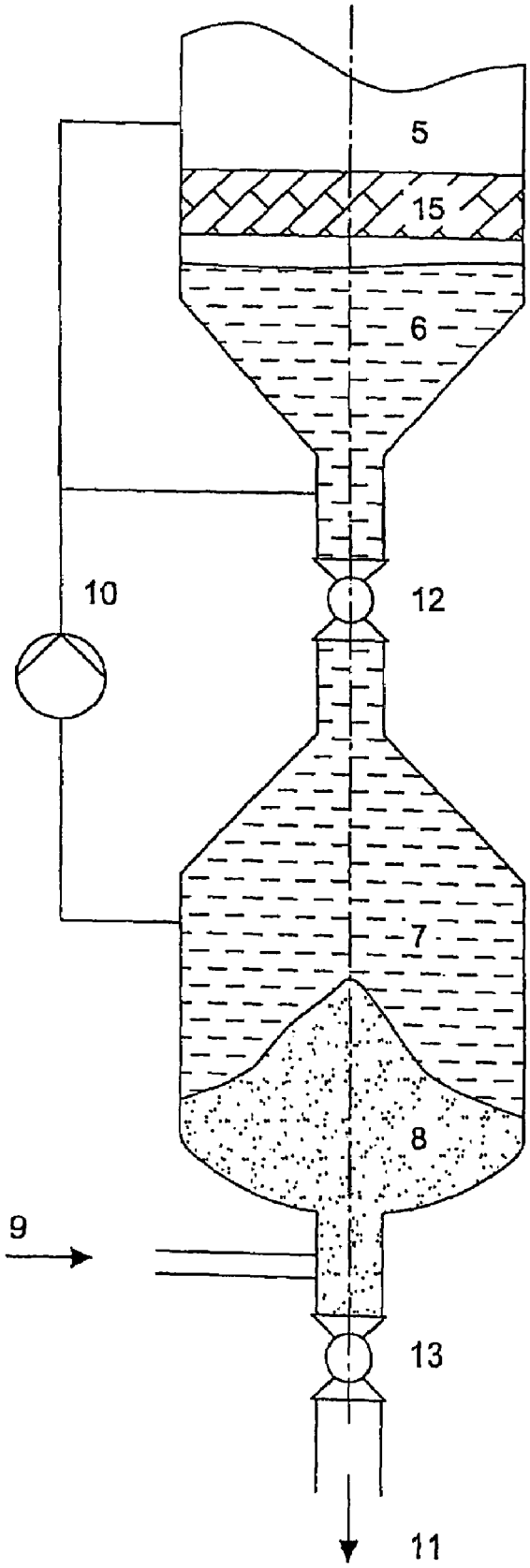
FIG. 2 shows a solution of the invention with quench chamber, slag bath and slag crusher.

FIG. 2 shows the invention with a slag crusher 15. In order to allow for evacuation of slag in the form of big lumps, a slag crusher 15 is mounted in the lower part of quench chamber 5. In order to avoid deposits, mainly of fine slag, in water bath 6, water is recirculated by means of pump 10 from slag lock hopper 7 through the water circuit line and supplied above and beneath slag crusher 15. This helps in discharging fine grains. As in FIG. 1, water is additionally introduced in the lower part of slag lock hopper 7 in order to achieve both loosening of bulk slag 8 and desired cooling prior to expansion.

Accordingly, while only a few embodiments of the present invention have been shown and described, it is obvious that many changes and modifications may be made thereunto without departing from the spirit and scope of the invention.

What is claimed is:

1. A method for loosening deposited slag in a reactor for pressure gasification of fuels, said fuels including coals of various ranks, cokes, or ash- containing liquids or liquid-solid suspensions, at pressures between ambient pressure and 80 bar, at gasification temperatures ranging between 800 and 1800° C., in an arrangement comprising a quench chamber mounted downstream of a gasification chamber and a slag lock hopper disposed thereafter, a valve connecting the quench chamber and slag lock hopper, and a water bath in a lower part of the quench chamber, the method comprising the following steps:

supplying quench water at a level above the water bath for cooling down the crude gas and slag from the gasification chamber; and maintaining a water circuit between the quench chamber, the valve, the slag lock hopper and a pump, said circuit water being circulated above and below a level of the water bath and said valve being in an open position, wherein said circuit water is supplied through circuit lines separate from the quench water input, wherein the circuit water is pumped backward and forward in the circuit lines between the quench chamber and the slag lock hopper, the quench chamber and the water bath, and the slag lock hopper and the water bath.

2. The method according to claim 1, further comprising the step of supplying additional water to a lower part of the slag lock hopper at a temperature of between 20 and 90° C. in order to cool a water bath and the slag and to avoid or minimize the formation of vapor during expansion of the lock hopper.

3. The method according to claim 2, wherein the steps of maintaining the water circuit and supplying additional water at temperatures ranging between 20 and 90° C. to the lower part of the slag lock hopper are performed simultaneously.

4. The method as according to claim 2, wherein the steps of maintaining a water circuit and supplying additional water at temperatures ranging between 20 and 90° C. to the lower part of the slag lock hopper are performed alternately.

5. The method according to claim 2, wherein the steps of maintaining the water circuit and supplying additional water at temperatures ranging between 20° and 90° C. to the lower part of the slag lock hopper are performed continuously or discontinuously.

6. The method according to claim 1, wherein the slag is shredded in the lower part of the quench chamber.

* * * * *